US005401021A

United States Patent [19]

Allen

[11] Patent Number: 5,401,021

[45] Date of Patent: Mar. 28, 1995

[54] SET OF GOLF CLUB IRONS WITH ENLARGED FACES

[75] Inventor: Dillis V. Allen, Elgin, Ill.

[73] Assignee: Vardon Golf Company, Inc., Elk Grove Village, Ill.

[21] Appl. No.: 139,720

[22] Filed: Oct. 22, 1993

[51] Int. Cl.[6] ..... A63B 53/00

[52] U.S. Cl. ..... 273/77 A; 273/80 C; 273/167 G; 273/167 J

[58] Field of Search ..... 273/77 R, 77 A, 80.2, 273/80 B, 80 C, 169, 175, 167 F, 167 G, 167 J

[56] References Cited

U.S. PATENT DOCUMENTS

| | | | |
|---|---|---|---|
| 3,751,035 | 8/1973 | Lockwood | 273/77 A |
| 3,847,399 | 11/1974 | Raymount | 273/167 F |
| 4,919,430 | 4/1990 | Antonious | 273/169 |
| 5,060,951 | 10/1991 | Allen | 273/167 H |
| 5,301,941 | 4/1994 | Allen | 273/77 |

*Primary Examiner*—William H. Grieb

[57] ABSTRACT

A set of golf club irons each with a vertically and horizontally enlarged face without any increase in club head overall weight. The face extends horizontally beyond the hosel to create true heel weighting and an increased radius of gyration. Face enlargement is achieved by crossed bridge span bars and a cellular network in a cavity behind the ball striking face that are both concave to achieve progressive perimeter weighting.

25 Claims, 3 Drawing Sheets

SET OF GOLF CLUB IRONS WITH ENLARGED FACES

RELATED APPLICATIONS

Applicant's pending U.S. design patent applications, Ser. No. 011,505 and Ser. No. 011,506, both filed Aug. 6, 1993 and entitled "Iron Golf Club With Progressive Perimeter Weighting", disclose similar iron-type clubs with progressive perimeter weighting. These applications claim the appearance of the club while the present application, in part, claims the functions of progressive perimeter weighting.

Also, applicant has four U.S. design patent applications, Ser. No. 013,867, Ser. No. 013,852, Ser. No. 013,853, and Ser. No. 013,860, all filed on Oct. 4, 1993, disclosing and claiming the appearance of four embodiments similar to the irons disclosed in the present application.

BACKGROUND OF THE INVENTION

Investment casting techniques innovated in the late 1960s have revolutionized the design, construction and performance of golf club heads up to the present time. Initially only novelty putters and irons were investment cast, and it was only until the early years of the 1980s that investment cast metal woods achieved any degree of commercial success. The initial iron club heads that were investment cast in the very late 1960s and early 1970s innovated the cavity backed club heads made possible by investment casting which enabled the molder and tool designer to form rather severe surface changes in the tooling that were not possible in prior manufacturing techniques for irons which were predominantly at that time forgings. The forging technology was expensive because of the repetition of forging impacts and the necessity for progressive tooling that rendered the forging process considerably more expensive than the investment casting process and that distinction is true today although there have been recent techniques in forging technology to increase the severity of surface contours albeit them at considerable expense.

The investment casting process, sometimes known as the lost wax process, permits the casting of complex shapes found beneficial in golf club technology, because the ceramic material of the mold is formed by dipping a wax master impression repeatedly into a ceramic slurry with drying periods in-between and with a silica coating that permits undercutting and abrupt surface changes almost without limitation since the wax is melted from the interior of the ceramic mold after complete hardening.

This process was adopted in the 1980s to manufacture "wooden" club heads and was found particularly successful because the construction of these heads requires interior undercuts and thin walls because of their stainless steel construction. In order to conform to commonly acceptable club head weights in both woods and irons, it was difficult to enlarge the ball striking surface. This ball striking surface, even utilizing a high strength stainless steel such as 17-4, without reinforcement, must have a thickness of at least 0.125 inches in metal woods to even heavier in irons to maintain its structural integrity for the high club head speed player of today who not uncommonly has speeds in the range of 100 to 150 feet per second at ball impact.

Faced with this dilemma of manufacturing a club head of adequate strength while limiting the weight of the club head, designers have found it difficult to increase the perimeter weighting effect of the club head.

Since the innovation of investment casting in iron technology in the late 1960s, perimeter weighting of iron clubs has been achieved by a redistribution of the weight of the head itself away from the hitting area to the perimeter around the hitting area, usually by providing a perimeter wall extending rearwardly from the face that results in a rear cavity behind the ball striking area. Such a club head configuration has been found over the last two plus decades to enable the average golfer, as well as the professional, to realize a more forgiving hitting area and by that we mean that somewhat off-center hits from the geometric center of the face of the club results in shots substantially the same as those hits on the center of the club. Today it is not uncommon to find a majority of professional golfers playing in any tournament with investment cast perimeter weighted irons confirming the validity of this perimeter weighting technology.

In the Raymont, U.S. Pat. No. 3,847,399 issued Nov. 12, 1974, assigned to the assignee of the present invention, a system is disclosed for increasing the perimeter weighting effect of a golf club by a pattern of reinforcing elements in the ball striking area that permits the ball striking area to be lighter than normal, enabling the designer to utilize that weight saved on the forward face by adding it to the perimeter wall and thereby enhancing perimeter weighting.

This technique devised by Mr. Raymont was adopted in the late 1980s by many tool designers of investment cast metal woods to increase the strength of the forward face of the metal woods to maintain the requirement for total overall head weight and to redistribute the weight to the relatively thin investment cast perimeter walls permitting these walls to not only have greater structural integrity and provide easier molding and less rejects, but also to enhance the perimeter weighting of these metal woods. Most major companies in the golf industry manufacturing metal woods in the late 1980s were licensed under the Raymont patent.

In 1991, the Allen, U.S. Pat. No. 5,060,951 issued entitled "Metal Headed Golf Club With Enlarged Face", also assigned to the assignee of the present invention, and it discloses an investment cast metal wood with an enlarged club face depth(height) on the order of at least 1.625 inches. Such a face depth was not formerly believed possible because of the requirement for face structural integrity under the high impact loads at 100 to 150 feet per second, and the weight requirement of the club head of 195 to 210 grams. In this Allen patent, a labyrinth of reinforcing elements similar to Mr. Raymont's was utilized not to re-distribute face weight but instead to enlarge face area while maintaining overall club head weight. An ancillary and important advantage of this development, utilized by many present day designers of "jumbo" metal wood heads, is the fact that an enlarged club face produces a sweet spot enlargement far greater than the enlargement of the club face itself.

Another problem addressed by the present invention is the achievement of increasing the benefits of perimeter weighting by simply adding weight to the perimeter of the club head itself. This technique of course has found considerable success in low impact club heads such as putters, where overall club head weight is in no way critical, and in fact in many low impact clubs that have found considerable commercial success, the club heads weigh many times that of metal wood heads, sometimes three or four times as heavy.

To this date, however, increased perimeter weighting has not been found easy because of the weight and impact strength requirements in high impact clubs. An understanding of perimeter weighting must necessarily include a discussion of the parameter radius of gyration. The radius of gyration in a golf club head is defined as the radius from the geometric or ball striking axis of the club along the club face to points of club head mass under consideration. Thus, in effect the radius of gyration is the moment arm or torquing arm for a given mass under consideration about the ball striking point. The total moments acting on the ball during impact is defined as the sum of the individual masses multiplied by their moment arms or "radii of gyration". And this sum of the moments can be increased then by either increasing the length of the individual moment arms or by increasing the mass or force acting at that moment arm or combinations of the two.

Since it is not practical, except for the techniques discussed in the above Raymont and Allen patents, to add weight to the perimeter wall because of weight limitations, one alternative is to increase the moment arm or radius of gyration. This explains the popularity of today's "jumbo" woods although many of such woods do not have enlarged faces because of the requirement for structural integrity in the front face.

In the Allen, U.S. patent application, Ser. No. 882,561, now U.S. Pat. No. 5,301,941, some of these problems are solved with a composite face wall that includes an impact supporting wall that is investment cast with the remainder of the head(without the sole plate which is a separate piece as cast). This impact supporting wall is rigidified by a pattern of integrally cast reinforcing bars that extend forwardly from the forward wall rather than rearwardly as described in the above discussed Raymont and Allen patents. This reinforcing pattern has a depth of approximately 0.150 inches which is significantly greater than reinforcing patterns possible on the rear of the ball striking faces of prior constructions. This increased depth provides far greater supporting wall reinforcement. It is also easily cast because the core piece that forms these deep depth reinforcing elements are removed by a direct forward withdrawal unencumbered by the perimeter wall that inhibits rearward core withdrawal inside the club head. In the exemplary embodiment of this pattern of reinforcing bars, the reinforcing bars are formed into hexagonal unit cells having a major diameter of 0.500 inches, although other geometric patterns are within the scope of the present invention.

This reinforced supporting wall is covered by a very hard plastic ball striking insert that is cast in situ(in place) over the supporting wall. That is, after the head is investment cast, the forward wall is cleaned and vulcanized with a bonding agent and placed in a mold that carries the configuration of the outer surface of the insert and an elastomeric material is either poured or injected under pressure into the mold to form the insert. One material that has been found successful is a Shore D 75 hardness polyurethane, which results in a very hard high frequency ball striking surface. This plastic insert, not only provides a very hard ball striking surface, but more importantly because it is intimately bonded to the forward wall and the reinforcing bars, it provides an effective "I" beam support with the bars for the forward wall as opposed to a "T" beam support found in today's rearwardly reinforced ball striking wall. It can be easily demonstrated by engineering calculation that I beam supports for transverse loads are substantially stronger than T beam supports.

The increase in the radius of gyration is accomplished by extending the heel and toe portions of the club head further from the geometric center of the face wall, beyond present day parameters for high impact club heads. These extensions provide greater effective heel and toe weighting. The heel of the club head is formed by extending tending the club face significantly beyond the hosel, that is, on the side of the hosel opposite the ball striking area, and extending the top wall and rear wall to accommodate this extended face.

In my U.S. patent application entitled "METAL WOOD GOLF CLUB WITH TRUE HEEL AND TOE WEIGHTING", U.S. application Ser. No. 022,902, filed: Feb. 26, 1993, an improved metal wood golf club is provided having an enlarged or "jumbo" metal club head with a crowned top wall extending rearwardly from a ball striking face wall, a toe wall, and a heel wall also projecting rearwardly from the face wall—but the club head has no conventional sole plate.

In that design, the toe wall and the heel wall are enclosed by the top wall and a pair of spaced generally vertical weighting walls integral with and extending rearwardly from the face wall. The two areas enclosed by the top wall, heel and toe walls, and weight walls are hollow to achieve the desired head weight and the area between the walls is opened, and the weight of the sole plate that normally encloses that area is redistributed to the weight wall to achieve true heel and toe weighting.

Prior attempts to manufacture very large stainless steel metal club heads with larger than normal faces has proved exceedingly difficult because of weight requirements for club heads to achieve the most desirable club swing weights. Thus, to the present date stainless steel "jumbo" club heads have for the most part been manufactured with standard sized face walls. This has led to several manufacturers switching from stainless steel to aluminum alloys, which are of course lighter, to enlarge the head as well as the face.

Face enlargement was achieved in the design disclosure in my U.S. patent application, Ser. No. 022,904, by a combination of a honeycomb reinforcing network formed integrally on the rear surface of the forward wall between the weighting walls and a redistribution of the weight of the conventional sole plate, which is eliminated in that design, and the weight saved on the thinner than normal face wall to the weighting walls themselves. The two enclosed areas defined by the top wall, heel and toe walls, and weighting walls were hollow.

SUMMARY OF THE PRESENT INVENTION

In accordance with the present invention, a set of golf club irons is provided with each of the club heads in the set enlarged over standard irons in use today without any increase in any overall club head weight. By maintaining club head weight at standard values, the swing weights of the clubs remain in conventional ranges whether steel or graphite shafts be used.

The ball striking face is enlarged both vertically and horizontally and the horizontal extension is beyond the hosel in a direction away from the target line to create true heel weighting and an increased radius of gyration. That is, because weight is added to the face beyond the hosel, this weight is positioned further away from the ball striking area and hence has a longer moment arm and therefore creates a greater torquing effect on the ball at impact.

Face enlargement is achieved both by a pair of crossed bridge span bars and a unit cellular network in a cavity behind the ball striking face. The outer surface of both the crossed bridge span bars and the cellular network are smoothly concaved in the cavity and have a minimum depth at the ball striking point and increase in depth progressively in a geometric or $X^2$ progression to the perimeter wall in both horizontal and vertical directions. This creates a progressive perimeter weighting system that is completely unknown in the prior art.

Of course, golf designers are familiar with golf clubs where the shaft or hosel is displaced somewhat from the heel toward the toe, and these of course could be considered to be heel weighted clubs. One example of this style club is found in putters, and by far the most widely used putters today have their shafts displaced toward the toe from the heel. However, the length of putters, heel to toe, is not of any great significance because there is no weight limitation in putters as there is in the high impact woods and irons. Thus, the prior art of putters can be distinguished not only because of a lack of weight limitation requirements but also because prior art putters have no perimeter heel wall extending heelwise from the hosel. It is this peripheral heel wall that increases the radius of gyration of the present irons without any significant increase in club head weight.

There have also been a plurality of "Rube Goldberg" type high impact drivers in which the heel of the club head projects out in the heel direction from the hosel but insofar as I am aware, all of these have been solid mass heel projections and thus do not approach the problem of achieving an increase in radius of gyration without significant increase in overall club head weight. Furthermore, many of these heel weighted prior art high impact club heads have an otherwise unconventional club head shape that largely render them useless for the vast majority of golfers in the world.

Moreover, these prior art clubs do not conform to the USGA Rules regarding club head shape and configuration.

According to the present invention, an increase in the radius of gyration of the club head about the geometric center of the face along the target line, the ideal ball striking point, is achieved not only by perimeter wall heel weighting described above but also by face height extension and toe extension achieved by progressive perimeter weighting. Progressive perimeter weighting according to the present invention is achieved by three elements; namely, the horizontal concave bar in the rear cavity, a generally vertical bar also concave intersecting the horizontal bar, and a unit cellular configuration that has a concave configuration similar to that of the cross bars. The concave configuration of this three element perimeter weighting results in a reinforcing network that has its minimum depth at the geometric center and its maximum depth around the perimeter of the club head and namely at the perimeter wall, and hence the terminology "progressive perimeter weighting". These bars and network form a cantilever or bridge span support for the point of maximum force or the ideal ball impact point at the geometric center of the club face. That is, even though the reinforcement is the thinness at the point of ball impact, this point is supported by the perimeter wall through the four radiating bars which increase in thickness to the perimeter wall, as does the unit cellular structure. In effect, the geometric center of the club is the central span of a cantilever bridge such as the old Dusseldorf-Neuss Bridge originally constructed in 1928 in Dusseldorf, Germany. The same cantilevered concept is exemplified in the Brooklyn Bridge in New York City completed in 1883 with a span of 1,595 feet. In all of these bridge designs, the point of maximum load coincides with the point of minimum depth reinforcement. In both cantilever and suspension bridge design, as well as the earlier Roman circular ark bridge design, is the basic concept that the forces at the point of maximum stress are transferred from that point laterally to where the supporting structure has a maximum depth.

Other objects and advantages of the present invention will appear more clearly from the following detailed description.

DETAILED DESCRIPTION OF THE PREFERRED EMBODIMENT

Figure 1:
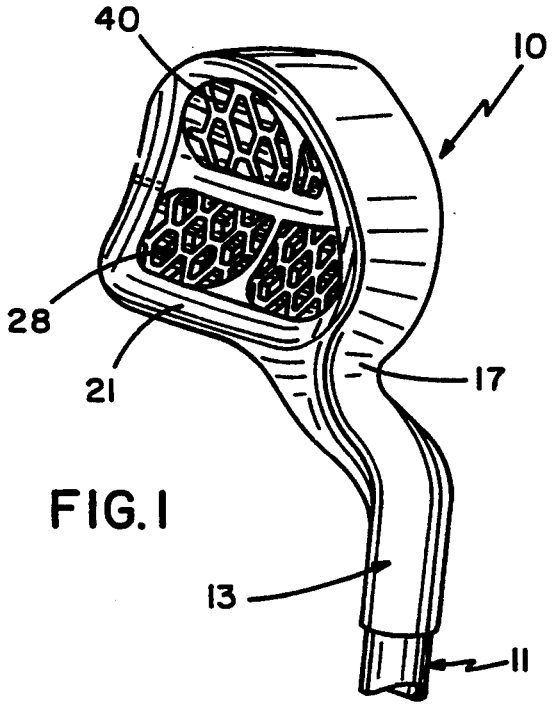
FIG. 1 is a rear heel perspective of a six iron in the present golf club iron set.
Figure 2:
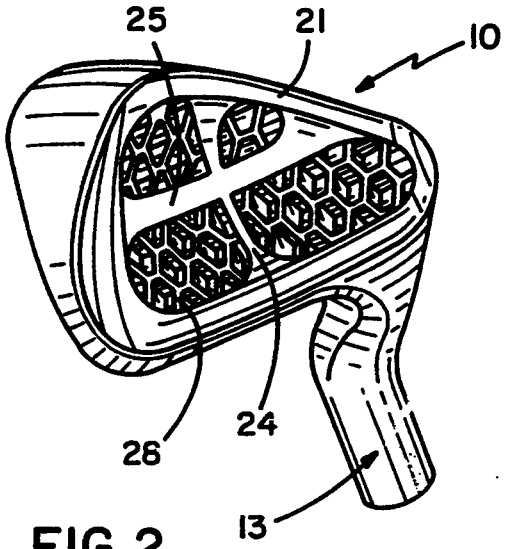
FIG. 2 is a rear toe perspective of the club head illustrated in FIG. 1.

Referring to the drawings and particularly FIGS. 1 to 8, an iron golf club head 10 is illustrated, and it takes the form in the drawings of a six iron having about 36 degrees of face loft. It should be understood, however, that that the principles of the present invention apply not just to a six iron but the other clubs in the iron set as well; namely, the one iron through the sand wedge, total of eleven irons. It should also be understood that the face size and heel weighting length achieved with the present invention exemplified in the six iron illustrated in the drawings, is progressively less to the one iron beginning with the five iron and progressively more to the sand wedge beginning with the seven iron.

Furthermore, a shaft 11 is illustrated only in fragmentary configuration in FIG. 1, but it should be understood that the present invention is directed to a completed golf club set including shafted and gripped heads.

The club head 10 is constructed of a metal alloy, and preferably a stainless steel alloy. Head 10 also is preferably an investment cast club head but with recent improvements in forging techniques, it may become possible to produce the rather complex shape of the head 10 with a forging process rather than an investment casting process.

Figure 3:
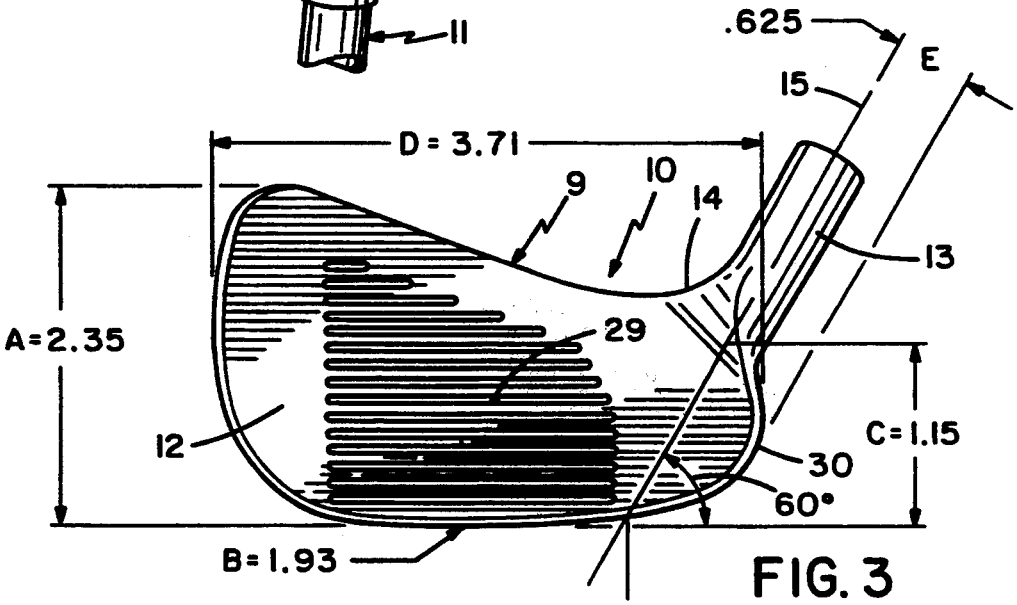
FIG. 3 is an enlarged front view of the club head illustrated in FIG. 1.
Figure 4:
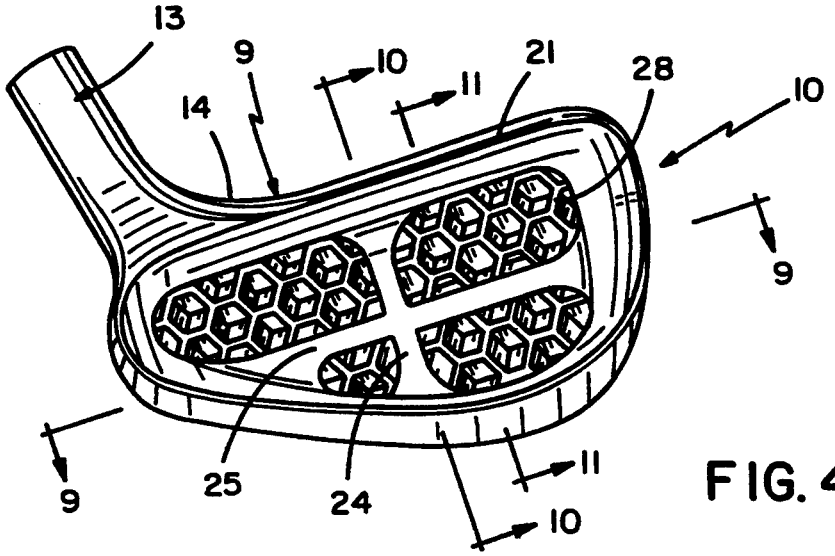
FIG. 4 is a rear view of the club head illustrated in FIG. 3.
Figure 5:
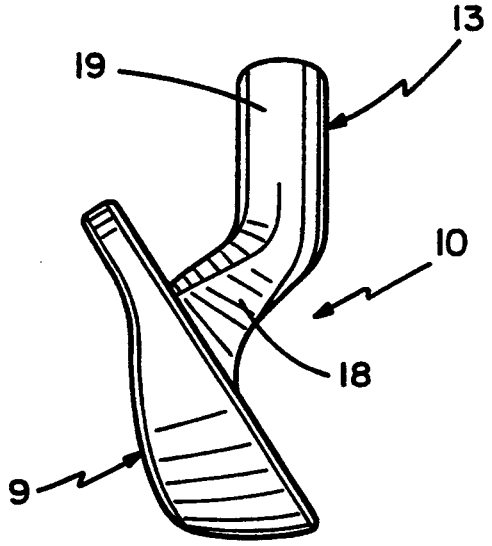
FIG. 5 is a left side view of the club head illustrated in FIGS. 1 to 4.
Figure 6:
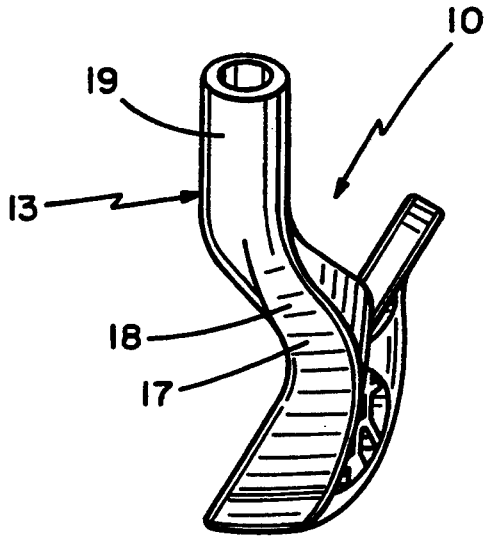
FIG. 6 is a right side view of the club head illustrated in FIGS. 1 to 5.
Figure 7:
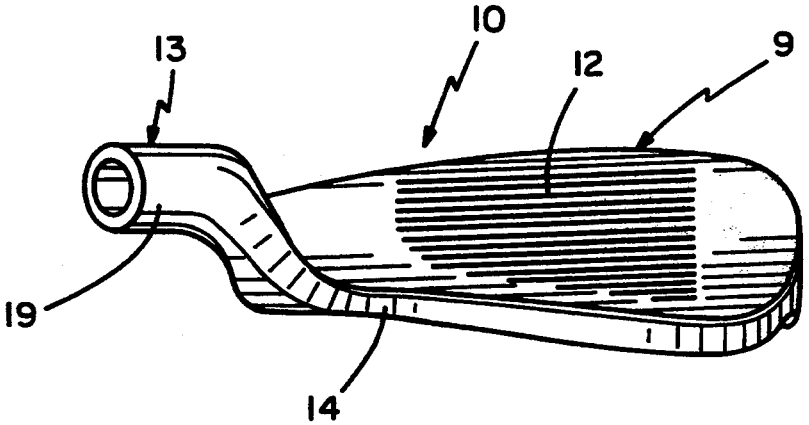
FIG. 7 is a top view of the club head illustrated in FIGS. 1 to 7.
Figure 8:
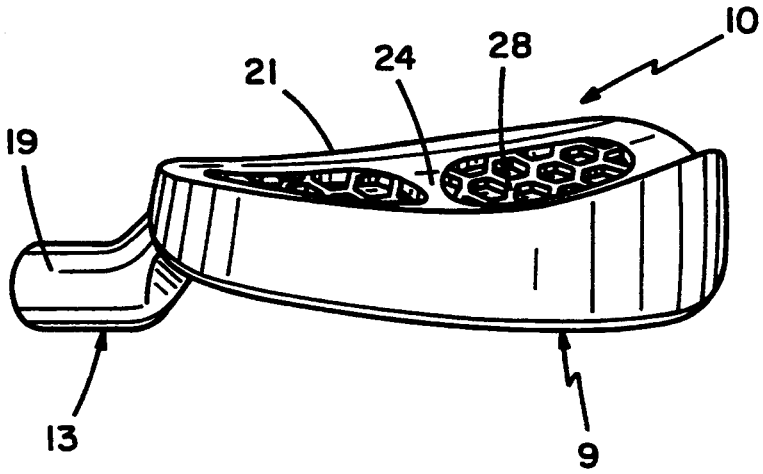
FIG. 8 is a bottom view of the club head illustrated in FIGS. 1 to 7.

Head 10 is seen to include a body 9 having a flat forward ball striking face 12 from which an L-shaped hosel 13 projects. Hosel 13 is a shaft receiving bore having an axis 15. As seen in the drawings, and particularly FIGS. 5 through 8, hosel 13 has as a first portion 17 that projects in an upwardly direction from face 12 and head top wall 14, has a forwardly bending portion 18, that in turn connects to an upwardly projecting shaft receiving portion 19. The central axes of each of hosel portions 17, 18 and 19 lie in a plane extending through the hosel axis 15 in a plane perpendicular to face 12 when viewed in FIG. 3. Expressed otherwise, in the plane of FIG. 3, portions 17, 18 and 19 extend equal distances to the right and left of axis 15. In the plane of FIG. 3, hosel axis 15 is 60 degrees to the horizontal, which is defined as the "lie" of the club.

As seen more clearly in FIGS. 4, 7, 8, 9, 10 and 11, the body 9 has a perimeter wall 21 extending completely there-around that projects rearwardly in a direction perpendicular to face 12. The perimeter wall 21 has crossed reinforcing bars 24 and 25 and a unit cellular network 28 form the progressive perimeter weighting according to the present invention that makes face enlargement possible and improved perimeter weighting without any increase in overall club head weight.

Because face enlargement and heel weighting are the essential objectives of the present invention, the actual dimensions of the face 12, and of course the body 9, are of importance to distinguish the present face enlargement from not only conventionally sized irons but to compare them to some of the oversized irons which have recently come to the marketplace. A is vertical face height at the toe, A =2.35 inches. B is the vertical face height at hitting area center 29(geometric center of club head), B=1.93 inches. C is the face height at the heel, C=1.15 inches. D is the horizontal length of the club face or body, D=3.71 inches. E is the extension of club head heel portion 30 from the axis 15 of the hosel in a direction perpendicular to the axis of the hosel in the plane of FIG. 3, E=0.625 inches.

This configuration results in a total area for club face 12 of 6.4562 sq. inches. This total club face area is substantially higher than conventionally sized irons presently known throughout the world.

Figure 9:
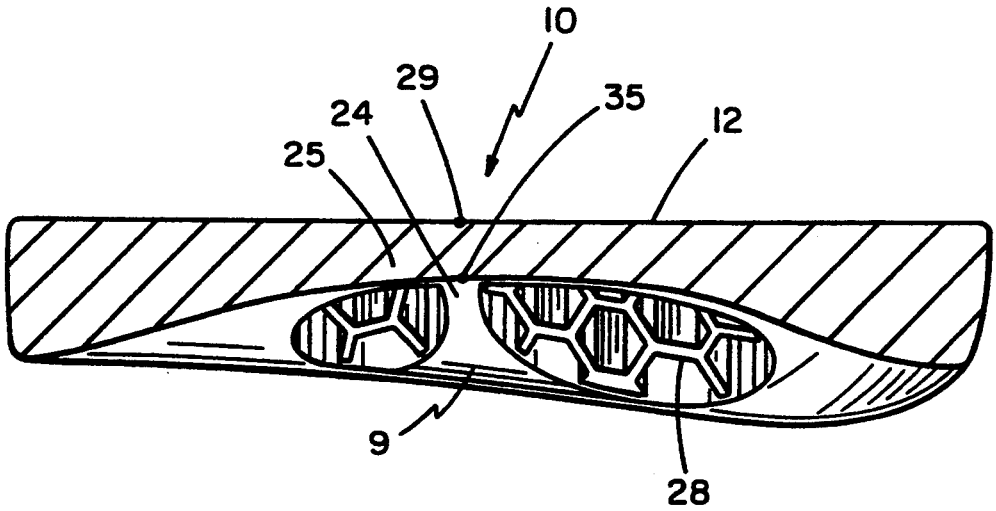
FIG. 9 is an enlarged longitudinal section taken generally along line 9—9 of FIG. 4.
Figure 10:
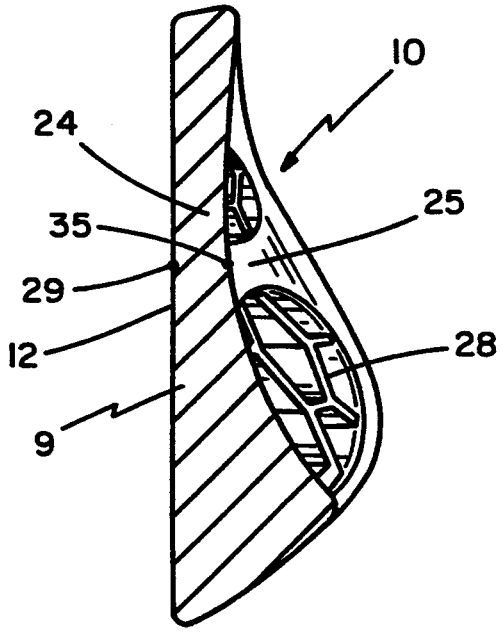
FIG. 10 is an enlarged cross-section taken generally along line 10—10 of FIG. 4.
Figure 11:
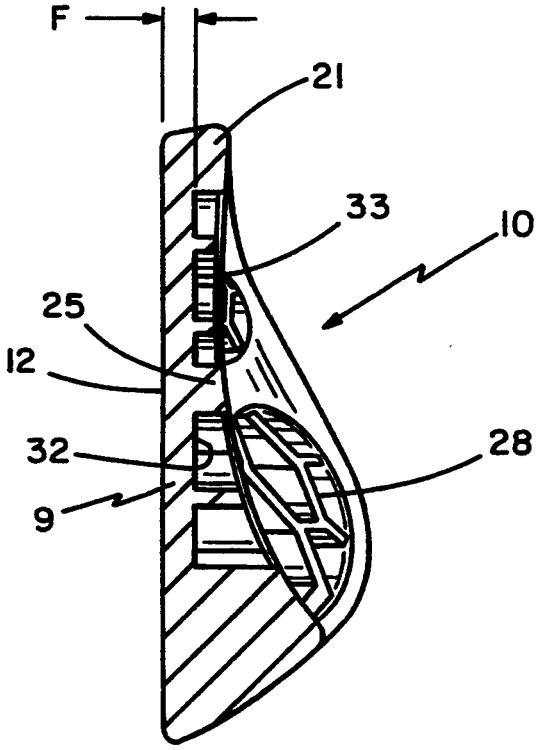
FIG. 11 is a cross-section taken generally along line 11—11 of FIG. 4.

As seen more clearly in FIGS. 9 through 11, the perimeter wall 21 defines a cavity 32 in the rear of the body 9 forming a rear face wall 33 that is parallel to ball striking face 12 that together form a face wall thickness F(FIG. 11). Normal face walls in iron clubs today, even those that are perimeter weighted as is the present club, are on the order of 0.160 inches. According to the present invention and as a result of the unit cellular structure 28 and the crossed reinforcing bars 24 and 25, the face wall thickness F is reduced to 0.120 inches creating a substantially lighter face that enables the saved weight to be redistributed into a heavier progressive perimeter weighting system and also it permits the face to be enlarged. Thickness F can be less than 0.120 inches and can in fact be reduced to nearly zero if the bars 24 and 25, the cellular structure 28, and the perimeter wall 21 are sufficiently strong. Of course, to prevent ball damage and accommodate casting shrinkage, wall thickness F would probably not go below 0.050 inches. Also it should be understood that face thickness F, as shown in FIGS. 9 to 11, is exaggerated compared to the other dimensions and is actually thinner than shown in these views.

As seen in the drawings, the vertical cross bar 24 and the horizontal cross bar 25 intersect at a point symmetrical about the geometric center 29 of the club face, and they both have their thinnest point at center 29 as shown in the vertical section of FIG. 11. Actually the rearward projection of the cross bars 24 and 25 at point 35(coaxial with point 29) in FIG. 35 is actually only 0.030 inches and is exaggerated in FIGS. 9 to 11 simply for clarity. From this minimum point 35, the crossed bars 24 and 25, as well as cellular structure 28, increase in thickness from cavity bottom wall 33 in a substantially parabolic curve($KX^2$) to the perimeter wall 21. K is a constant and X is the incremental distance from the bottom of the cavity in a direction perpendicular to the cavity bottom rearwardly to the rear of the bars. K is substantially less than one for bar 25 and about one for bar 24. This curvature actually provides a bridge span arch or cantilever type support around the impact area which of course surrounds hitting point 28.

The unit-cell structure 28 is somewhat similar to that shown in the Raymont, U.S. Pat. No. 3,847,399 except that it also has its minimum depth value at point 35 and progressively increases in thickness out to the perimeter wall 21 but is slightly less thick where it meets the perimeter wall as illustrated at 37 in FIG. 11.

The unit-cellular structure 28 is defined by a plurality of hexagonal cells 40, many of which are surrounded by other hexagonal cells. The walls of the cells 40 are integral with the walls of the adjacent cells and where they meet the bars 24 and 25 and the perimeter wall 21 are also integral with these elements forming a very high strength supporting structure for the club face 12 that enables the face to be made thinner and the saved weight utilized to enhance perimeter weighting and to permit the face enlargement described above.

I claim:

1. A set of iron type of golf clubs, comprising:

a plurality of iron type golf clubs having gradually increasing face lofts and substantially the same swing weights, each of the clubs including a shaft, a metal club head with a hosel, said head having a generally planar body with a planar ball striking face and heel and toe portions, said ball striking face having a geometric center point that defines a ball striking area, said hosel projecting upwardly and integrally from the body, said hosel having a shaft receiving bore with an axis, said axis lying in a vertical plane perpendicular to a desired target line, said target line lying in a vertical plane perpendicular to the ball striking face and passing through the geometric center point on the face, said body having a perimeter weighting wall extending rearwardly from the ball striking face and partly defining the heel and toe portions of the club, and means for increasing the radius of gyration of the club head including said heel portion defining portions of the ball striking face and the perimeter wall extending in the plane of the face a substantial distance outwardly from the hosel in a direction from the hosel opposite the vertical plane containing the target line.

2. A set of iron type of golf clubs, comprising:

a plurality of iron type golf clubs having gradually increasing face lofts and substantially the same swing weights, each of the clubs including a shaft, a metal club head with a hosel, said head having a generally planar body with a planar ball striking face and heel and toe portions, said ball striking face each having a geometric center point that defines a ball striking area, said hosel projecting upwardly and integrally from the body, said hosel having a shaft receiving bore with an axis, said axis lying in a vertical plane perpendicular to a desired target line, said target line lying in a vertical plane perpendicular to the ball striking face and passing through the geometric center point on the face, said body having a perimeter weighting wall extending rearwardly from the ball striking face and partly defining the heel and toe portions of the club, means for increasing the radius of gyration of the club head including said heel portion including portions of the ball striking face and the perimeter wall extending in the plane of the face a substantial distance outwardly from the hosel in a direction from the hosel opposite the vertical plane containing the target line, said ball striking face in the six iron of the set having a frontal area of at least 6.0 in.$^2$ and the lower lofted faces being proportionately smaller and the higher lofted faces being proportionately larger, and means for enlarging the area of the ball striking face to the above value without increasing head weight including a ball striking face reinforcing network in the rear cavity of the club head defined by the perimeter wall, said cavity having a bottom wall substantially parallel to and rearwardly spaced from the ball striking face, the distance between the ball striking face and the cavity bottom wall being the face thickness, said reinforcement being sufficient so the face thickness can be reduced and the saved weight utilized to achieve the enlarged face without increasing overall club head weight over the appropriate values for the loft of the club head.

3. A set of iron type of golf clubs, comprising:

a plurality of iron type golf clubs having gradually increasing face lofts and substantially the same swing weights, each of the clubs including a shaft, a metal club head having a hosel, said head having a generally planar body with a planar ball striking face and heel and toe portions, said ball striking face each having a geometric center point that defines a ball striking area, said hosel projecting upwardly and integrally from the body, said hosel having a shaft receiving bore with an axis, said axis lying in a vertical plane perpendicular to a desired target line, said target line lying in a vertical plane perpendicular to the ball striking face and passing through the geometric center point on the face, said body having a perimeter weighting wall extending rearwardly from the ball striking face and partly defining the heel and toe portions of the club, said ball striking face having an area of at least 6 in.$^2$ for the six iron in the set and progressively smaller in the lower lofted clubs and progressively larger in the higher lofted clubs, and means for enlarging the ball striking face to the above value without increasing head weight including a ball striking reinforcing network in the rear cavity of the club head defined by the perimeter wall, said cavity having a bottom wall substantially parallel to and rearwardly spaced from the ball striking face, the distance between the ball striking face and the cavity bottom wall being the face thickness, said reinforcement being sufficient so the face thickness can be reduced and the saved weight utilized to achieve the enlarged face without increasing overall club head weight over the appropriate values for the loft of the club head.

4. A set of iron type of golf clubs, comprising:

a plurality of iron type golf clubs having gradually increasing face lofts and substantially the same swing weights, each of the clubs including a shaft, a metal club head, said head having a generally planar body with a planar ball striking face and heel and toe portions, said ball striking face each having a geometric center point that defines a ball striking area, said hosel projecting upwardly and integrally from the body, said hosel having a shaft receiving bore with an axis, said axis lying in a vertical plane perpendicular to a desired target line, said target line lying in a vertical plane perpendicular to the ball striking face and passing through the geometric center point on the face, said body having a perimeter weighting wall extending rearwardly from the ball striking face and partly defining the heel and toe portions of the club, said perimeter wall defining a cavity in the rear of the club head having a bottom wall generally parallel to and spaced from the ball striking wall, the distance between the bottom wall and the face wall being face thickness, and means for increasing the effective hitting area or sweet spot without increasing overall club head weight including a plurality of reinforcing elements integral with the perimeter wall and the cavity bottom wall extending completely across the cavity, said reinforcing elements extending in a direction perpendicular to the bottom wall defined as element thickness, said element thickness being at its minimum value at the hitting area of the face wall and generally progressively increasing in value outwardly to the perimeter wall.

5. A set of iron type of golf clubs as defined in claim 4, wherein the reinforcing elements include a generally horizontal bar and a generally perpendicular related generally vertical bar, said bars defining a generally spheroidal concave rear surface for the club head body.

6. A set of iron type of golf clubs as defined in claim 4, wherein the reinforcing elements include a unit cellular structure consisting of a plurality of unit cells encapsulated by other cells, the unit cellular structure having an outer surface that defines a generally spheroidal concave rear surface for the club head body.

7. A golf club, comprising:

a shaft, a clubhead receiving said shaft including a head portion and a shaft receiving hosel portion, said head having a face wall, and means to reinforce the face wall and enlarge the effective hitting area of the golf club including an integral perimeter wall extending rearwardly from and surrounding the face wall defining a cavity in the rear of the head, and a progressive face wall reinforcing element in the cavity extending from the approximate center of the rear of the face wall outwardly in the cavity to the perimeter wall, said element being integral with both the face wall and the perimeter wall, said reinforcing element incrementally increasing in height from the approximate center of the rear of the face wall to the perimeter wall, whereby the club face is supported by at least one structural arch.

8. A golf club as defined in claim 7, wherein the weighting element includes four weighting elements formed integrally with the forward wall each having a minimum depth near the center of the face wall and a maximum depth at the perimeter wall.

9. A golf club, comprising:

a shaft, a clubhead receiving said shaft including a head portion and a shaft receiving hosel portion, said head having a face wall, and means to enlarge the effective hitting area of the golf club including an integral perimeter wall extending rearwardly from the face wall and a progressive weighting element incrementally increasing in weight in at least one direction from the approximate center of the rear of the face wall to the perimeter wall, whereby the club face is supported by at least one structural arch, said weighting element being integral with the perimeter wall, said weighting element being a unit cellular structure formed integrally with the face wall having a minimum incremental weight and depth near the geometric center of the face wall and having a significantly higher incremental weight and depth adjacent the perimeter wall.

10. A golf club as defined in claim 9, wherein the unit cellular structure smoothly increases in depth from a point near the geometric center of the face wall to the perimeter wall.

11. A golf club, comprising:

a shaft, a club head receiving the shaft including a head portion and a hosel receiving the shaft, said head portion having a face wall with a rear surface, means for increasing the effective hitting area of the golf club including a concave cavity in the rear surface of the face wall having a maximum depth near the geometric center of the face wall and smoothly and progressively decreasing in depth to the perimeter of the head portion both horizontally and vertically from near the geometric center of the head portion, so the face wall has a minimum thickness near its geometric center and gradually increasing thickness in all directions from that center to the perimeter of the club, whereby the hitting area of the face wall is supported by incrementally increasing sections, said face wall increasing in thickness from near the geometric center according to the equation $KX^2$ where K is a constant and X is the distance from the face wall in a direction perpendicular to the face wall rearwardly to the rear of the cavity, and where K is about 1 in at least one vertical direction from near the geometric center of the face wall and K is substantially less than 1 in at least one horizontal direction from near the geometric center of the face wall.

12. A golf club, comprising:

a shaft, a clubhead receiving said shaft including a head portion and a shaft receiving hosel portion, said head having a face wall, and means to enlarge the effective hitting area of the golf club including an integral perimeter wall extending rearwardly from the face wall and a pair of crossed reinforcing bars formed integral with the rear of the face wall and extending outwardly to and integral with the face wall, at least a portion of at least one of the bars increasing in depth from a point near the geometric center of the face wall to the perimeter wall.

13. A golf club as defined in claim 13, wherein the bar portion increases in depth according to the equation $KX^2$ where K is a constant, and X is the distance from the rear of the face wall to the rear of the reinforcing bars.

14. A golf club, comprising:

a shaft, a clubhead receiving said shaft including a head portion and a shaft receiving hosel portion, said head having a face wall, and means for reinforcing the face wall to significantly increase the size of the face wall of the golf club including an integral perimeter wall extending rearwardly from and surrounding the face wall defining a cavity in the rear of the head, and a plurality of face wall reinforcing cancelled elements in the cavity and projecting rearwardly therefrom, said elements extending from the approximate center of the rear of the face wall outwardly in the cavity to the perimeter wall, said elements being integral with both the face wall and the perimeter wall, at least one of the elements incrementally increasing in height from the approximate center of the rear of the face wall to the perimeter wall, whereby the club face is supported by at least one structural arch.

15. A golf club as defined in claim 14, wherein the weighting element includes four weighting elements formed integrally with the forward wall each having a minimum depth near the center of the face wall and a maximum depth at the perimeter wall.

16. A golf club, comprising:

a shaft, a clubhead receiving said shaft including a head portion and a shaft receiving hosel portion, said head having a face wall, and means for significantly increasing the size of the face wall of the golf club including an integral perimeter wall extending rearwardly from the face wall and a progressive weighting element incremental increasing in weight in at least one direction from the approximate center of the rear of the face wall to the perimeter wall, whereby the club face is supported by at least one structural arch, said weighting element being integral with the perimeter wall, said weighting element being a unit cellular structure formed integrally with the face wall having a minimum incremental weight and depth near the geometric center of the face wall and having a significantly higher incremental weight and depth adjacent the perimeter wall.

17. A golf club as defined in claim 16, wherein the unit cellular structure smoothly increases in depth from a point near the geometric center of the face wall to the perimeter wall.

18. A golf club, comprising:

a shaft, a club head receiving the shaft including a head portion and a hosel receiving the shaft, said head portion being a face wall with a rear surface, means for significantly increasing the size of the face wall of the golf club including a concave cavity in the rear surface of the face wall having a maximum depth near the geometric center of the face wall and smoothly and progressively decreasing in depth to the perimeter of the head portion both horizontally and vertically from near the geometric center of the head portion, so the face wall has a minimum thickness near its geometric center and gradually increasing thickness in all directions from that center to the perimeter of the club, whereby the hitting area of the face wall is supported by incrementally increasing sections, said face wall increasing in thickness from near the geometric center according to the equation $KX^2$ where K is a constant, X is the distance from the front of the face wall to the rear surface of the face wall, and where K is about 1 in at least one vertical direction from near the geometric center of the face wall and K is substantially less than 1 in at least one horizontal direction from near the geometric center of the face wall.

19. An iron golf club, comprising: a shaft, a club head having a head portion and a shaft receiving hosel portion, said head portion having a face wall with a hitting area, means for increasing the radius of gyration of the golf club about an approximately centrally located hitting area including a perimeter wall extending rearwardly from the face wall defining a rear cavity in the head portion, said perimeter wall having a substantial straight top portion running along the top of the face wall having a toe area and a heel area, said hosel having a first portion integral with and extending upwardly from the heel area of the top portion of the perimeter wall, a second portion curving forwardly from the first portion and a third shaft receiving portion extending upwardly from the second portion, said third portion of the hosel having an axis, said perimeter wall having a curved heel portion projecting from the hosel, when viewing the clubhead from the rear, substantially from the hosel in a direction opposite the hitting area of the face wall, said heel portion of the face wall extending not more than 0.625 inches from the axis of the third portion of the hosel in a direction perpendicular to the hosel axis.

20. An iron golf club as defined in claim 19, including means for significantly increasing the size of the face wall of the golf club including an integral perimeter wall extending rearwardly from the face wall and a progressive weighting element incremental increasing in weight in at least one direction from the approximate center of the rear of the face wall to the perimeter wall, whereby the club face is supported by at least one structural arch, said weighting element being integral with the perimeter wall.

21. An iron golf club as defined in claim 20, wherein the weighting elements are formed integrally with the forward wall each having a minimum depth near the center of the face wall and a maximum depth at the perimeter wall.

22. An iron golf club as defined in claim 20, wherein the weighting element is a unit cellular structure formed integrally with the face wall having a minimum incremental weight and depth near the geometric center of the face wall and having a significantly higher incremental weight and depth adjacent the perimeter wall.

23. An iron golf club as defined in claim 22, wherein the unit cellular structure smoothly increases in depth from a point near the geometric center of the face wall to the perimeter wall.

24. An iron golf club as defined in claim 20, including means for significantly increasing the size of the face wall including a pair of crossed reinforcing bars formed integral with the rear of the face wall and extending outwardly to and integral with the face wall, at least a portion of at least one of the bars increasing in depth from a point near the geometric center of the face wall to the perimeter wall.

25. An iron golf club as defined in claim 24, wherein the bar portion increases in depth according to the equation $KX^2$ where K is a constant, and X is the distance from the rear of the face wall to the rear of the reinforcing bars.

* * * * *

UNITED STATES PATENT AND TRADEMARK OFFICE

CERTIFICATE OF CORRECTION

PATENT NO. : 5,401,021
DATED : March 28, 1995
INVENTOR(S) : Dillis V. Allen

It is certified that error appears in the above-identified patent and that said Letters Patent is hereby corrected as shown below:

Column 12,
Line 25, delete “weighting” and replace with -- reinforcing --.
Line 25, delete “weighting” and replace with -- reinforcing --.

Signed and Sealed this

Twelfth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,401,021
APPLICATION NO. : 08/139720
DATED : March 28, 1995
INVENTOR(S) : Dillis V. Allen It is certified that error appears in the above-identified patent and that said Letters Patent is hereby corrected as shown below:

Col. 12 Lines 4-23 Claim 14 insert

14. A golf club, comprising: a shaft, a clubhead receiving said shaft including a head portion and a shaft receiving hosel portion, said head having a face wall, and means for reinforcing the face wall to significantly increase the size of the face wall of the golf club including an integral perimeter wall extending rearwardly from and surrounding the face wall defining a cavity in the rear of the head, and a plurality of face wall reinforcing [cancelled] elements in the cavity and projecting rearwardly therefrom, said elements extending from the approximate center of the rear of the face wall outwardly in the cavity to the perimeter wall, said elements being integral with both the face wall and the perimeter wall, at least one of the elements incrementally increasing in height from the approximate center of the rear of the face wall to the perimeter wall, whereby the club face is supported by at least one structural arch.

Signed and Sealed this

Twenty-third Day of October, 2007

JON W. DUDAS
*Director of the United States Patent and Trademark Office*